United States Patent [19]

Vanier et al.

[11] Patent Number: 4,748,150

[45] Date of Patent: May 31, 1988

[54] SUBBING LAYER FOR DYE IMAGE-RECEIVING LAYER USED IN THERMAL DYE TRANSFER

[75] Inventors: Noel R. Vanier, Rochester; Kin K. Lum, Webster, both of N.Y.

[73] Assignee: Eastman Kodak Company, Rochester, N.Y.

[21] Appl. No.: 97,228

[22] Filed: Sep. 15, 1987

[51] Int. Cl.[4] ..... B41M 5/26

[52] U.S. Cl. ..... 503/227; 8/471; 346/135.1; 427/146; 427/256; 428/195; 428/412; 428/513; 428/518; 428/913; 428/914

[58] Field of Search ..... 8/470, 471; 346/135.1; 427/146, 256; 428/195, 412, 513, 518, 913, 914; 503/227

[56] References Cited

U.S. PATENT DOCUMENTS 4,626,256 12/1986 Kawasaki et al. ..... 428/914

FOREIGN PATENT DOCUMENTS 8519138 1/1985 Japan ..... 503/227

OTHER PUBLICATIONS

U.S. Patent Application Ser. No. 910,551 of Vanier et al, filed 9/23/86.

*Primary Examiner*—Bruce H. Hess
*Attorney, Agent, or Firm*—Harold E. Cole

[57] ABSTRACT

A dye-receiving element for thermal dye transfer comprises a support, such as polyethylene-coated paper or poly(ethylene terephthalate), having thereon a subbing layer of a vinylidene chloride copolymer and a polymeric dye image-receiving layer, such as a polycarbonate.

Use of the subbing layer of the invention improves the adhesion of the dye image-receiving layer to the support.

20 Claims, No Drawings

SUBBING LAYER FOR DYE IMAGE-RECEIVING LAYER USED IN THERMAL DYE TRANSFER

This invention relates to dye-receiving elements used in thermal dye transfer, and more particularly to the use of a subbing layer between the support and a polymeric dye image-receiving layer to improve the adhesion of the dye image-receiving layer to the support.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

In Japanese laid open publication number 19,138/85, an image-receiving element for thermal dye transfer printing is disclosed. The dye image-receiving layer disclosed comprises a polycarbonate containing a plasticizer.

U.S. Ser. No. 910,551 of Vanier and Lum, filed Sept. 23, 1986, relates to dye-receiving elements for thermal dye transfer having a high molecular weight polycarbonate dye image-receiving layer.

While polycarbonate is a desirable material for a dye image-receiving layer because of its effective dye compatibility and receptivity, there is a problem in getting proper adhesion of the layer to the support.

It would be desirable to provide a dye-receiving element which would have good adhesion between a polymeric dye image-receiving layer and the support.

These and other objects are achieved in accordance with this invention which comprises a dye-receiving element for thermal dye transfer comprising a support having thereon a subbing layer comprising a vinylidene chloride copolymer and a polymeric dye image-receiving layer.

In a preferred embodiment of the invention, the vinylidene chloride copolymer comprises from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride.

Any ethylenically unsaturated monomer which is different from the other monomers in the polymer can be used to prepare the polymer described above including alkyl acrylates and methacrylates such as methyl acrylate, ethyl acrylate, propyl acrylate, butyl acrylate, or butyl methacrylate; vinyl esters, amides, nitriles, ketones, halides, ethers, olefins, or diolefins as exemplified by acrylonitrile, methacrylonitrile, styrene, α-methyl styrene, acrylamide, methacrylamide, vinyl chloride, methyl vinyl ketone, fumaric, maleic and itaconic esters, 2-chloroethylvinyl ether, dimethylaminoethyl methacrylate, 2-hydroxyethyl methacrylate, N-vinylsuccinamide, N-vinylphthalamide, N-vinylpyrrolidone, butadiene, or ethylene. A preferred monomer is acrylonitrile.

Examples of ethylenically unsaturated carboxylic acids which can be included in the polymer described above include acrylic acid, methacrylic acid, itaconic acid, fumaric acid, maleic acid, or their anhydrides. The preferred carboxylic acids are acrylic acid and itaconic acid.

In a preferred embodiment of the invention, the subbing layer comprises from about 5 to about 35 percent by weight of acrylonitrile, from about 2 to about 10 percent by weight of acrylic acid, and from about 55 to about 85 percent by weight of recurring units of vinylidene chloride.

The subbing layer of the invention may be employed at any concentration which is effective for the intended purpose. In general, good results have been obtained at from about 0.03 to about 1.0 g/m$^2$ of coated element.

The polymer dye image-receiving layer of the dye-receiver of the invention may comprise, for example a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

In a preferred embodiment of the invention, the dye image-receiving layer is a polycarbonate. The term "polycarbonate" as used herein means a polyester of carbonic acid and a glycol or a dihydric phenol. Examples of such glycols or dihydric phenols are p-xylylene glycol, 2,2-bis(4-oxy-phenyl)propane, bis(4-oxyphenyl)methane, 1,1-bis(4-oxyphenyl)ethane, 1,1-bis-(oxyphenyl)butane, 1,1-bis(oxyphenyl)cyclohexane, 2,2-bis(oxyphenyl)butane, etc.

In another preferred embodiment of the invention, the polycarbonate dye image-receiving layer is a bisphenol-A polycarbonate having a number average molecular weight of at least about 25,000. In still another preferred embodiment of the invention, the bisphenol-A polycarbonate comprises recurring units having the formula

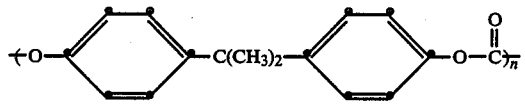

wherein n is from about 100 to about 500.

Examples of such polycarbonates include General Electric Lexan® Polycarbonate Resin #ML-4735 (Number average molecular weight app. 36,000), and Bayer AG Makrolon #5705® (Number average molecular weight app. 58,000). The later material has a $T_g$ of 150° C.

The support of the dye-receiving element of the invention may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be polyethylene-coated paoer which has been subjected to a corona discharge treatment. In a preferred embodiment, polyethylene-coated paper or poly(ethylene terephthalate) is employed. It may be employed at any thickness desired, usually from about 50 μm to about 1000 μm.

The corona discharge treatment that is used for the polyethylene-coated paper support can be carried out in an apparatus which as described in U.S. Pat. Nos. 2,864,755, 2,864,756, 2,910,723 and 3,018,189. Advantageously, the polyethylene-coated paper support is subjected to a corona discharge of from about 0.1 to about 3.5 rfa. For example, a 60-cycle Lepel high frequency generator operating at 6 kva. at 440 volts giving an output of 2.5 RF amps can be used with several metal electrodes close to the support at a point where it passes over a metal roll coated with a dielectric material. Similarly, a metal roller may be used to support the web with the other electrode array being in planatary disposition equidistant from the surface of the metal roller and each being coated with a dielectric at least on the surface nearest the metal roller. For further details, reference is made to U.S. Pat. No. 3,412,908, the disclosure of which is hereby incorporated by reference.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

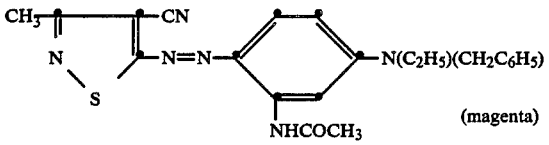

(magenta)

-continued

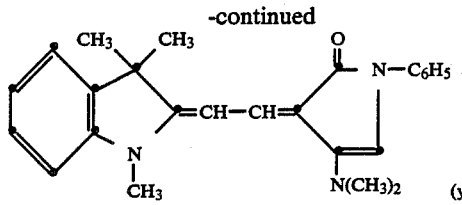

(yellow)

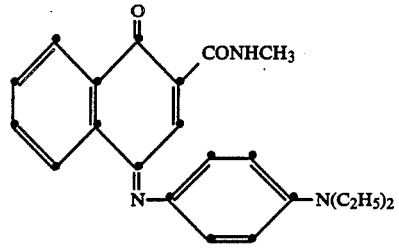

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose actate hydrogen phthalate, cellulose acetate, cellulose acetate propionate, cellulose actate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

A dye-barrier layer comprising a hydrophilic polymer may also be employed in the dye-donor element between its support and the dye layer which provides improved dye transfer densities. Such dye-barrier layer materials include those described and claimed in Application Ser. No. 934,968 entitled "Dye-Barrier/Subbing Layer for Dye-Donor Element Used in Thermal Dye Transfer" by Vanier et al, filed Nov. 25, 1986.

The reverse side of the dye-donor element may be coated with a slipping layer to prevent the printing head from sticking to the dye-donor element. such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C.

such as poly(vinyl stearate), beeswax, perfluorinated alkyl ester polyethers, phosphoric acid esters, silicone oils, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(styrene-co-acrylonitrile), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE 1

(A) A dye-receiver in accordance with the invention was prepared by coating the following layers on a 175 μm (7 mil) thick poly(ethylene terephthalate) (PET) support containing 8% by weight titanium dioxide:

(a) Subbing layer of poly(acrylonitrile-co-vinylidene chloride-co-acrylic acid (ANVcA) (14:79:7 wt. ratio) (0.13 g/m$^2$) coated from a butanone and cyclopentanone solvent mixture; and (c) Dye-receiving layer of Makrolon 5705 ® polycarbonate (Bayer AG) (2.9 g/m$^2$), 1,4-didecoxy-2,5-dimethoxybenzene (0.38 g/m$^2$), and FC-431 ® surfactant (3M Co.) (0.016 g/m$^2$) coated from methylene chloride.

(B) A control receiver was prepared similar to (A) except that it did not have any subbing layer.

(C) Other dye-receivers were prepared by coating the following layers on a 175 μm (7 mil) thick commercial paper stock consisting of 180 g/m$^2$ mixture of hard wood-craft and soft wood-sulfite bleach pulp:

(a) Pigmented polyethylene (PE) layer of total laydown 30 g/m$^2$ with approximately 12% by weight anatase titanium dioxide and 3% zinc oxide;

(b) Subbing layer of ANVcA in the amount stated in the table coated from a butanone and cyclopentanone solvent mixture; and (c) Dye-receiving layer of Makrolon 5705 ® polycarbonate (Bayer AG) (2.9 g/m$^2$), 1,4-didecoxy-2,5-dimethoxybenzene (0.38 g/m$^2$), and FC-431 ® surfactant (3M Co.) (0.016 g/m$^2$) coated from methylene chloride.

The PE-coated support was subjected to a corona discharge treatment (CDT) at approximately 450 joules/m$^2$ before applying the subbing layer.

(D) Control receivers were prepared similar to (C) except that they either did not have the corona discharge treatment, did not have any subbing layer, or had a known subbing layer of duPont Tyzor TBT ® titanium tetra-n-butoxide coated from 1-butanol as a solvent (0.16 g/m$^2$).

Each receiver element was subjected to a tape adhesion test. The receiver surface was first carefully scored in an "X" pattern. A small area (approximately ¾ inch×2 inches) of Scotch ® Magic Transparent Tape (3M Corp.) was firmly pressed by hand over the scored area of the receiver surface leaving enough area free to serve as a handle for pulling the tape. Upon manually pulling the tape, ideally none of the receiving layer would be removed. Receiving layer removal indicated a weak bond between a support and the receiving layer. The following categories were established:

E-excellent (no layer removal after two attempted tries with tape)

G-good (a small amount of layer removal after two tries)

F-fair (partial layer removal after two tries)

P-unacceptable (substantial or total layer removal upon one try)

The following results were obtained:

TABLE

| Subbing Layer (g/m$^2$) | Support | CDT | Tape Test |
|---|---|---|---|
| None (control) | PET | no | P |
| ANVcA (0.13) | PET | no | E |
| None (control) | PE-coated paper | yes | P |
| Tyzor (0.016 cont.) | PE-coated paper | yes | P |
| ANVcA (0.05 cont.) | PE-coated paper | no | P |

TABLE -continued

| Subbing Layer ($g/m^2$) | Support | CDT | Tape Test |
|---|---|---|---|
| ANVcA (0.05) | PE-coated paper | yes | E |
| ANVcA (0.11 cont.) | PE-coated paper | no | F |
| ANVcA (0.11) | PE-coated paper | yes | E |
| ANVcA (0.22 cont.) | PE-coated paper | no | F |
| ANVcA (0.22) | PE-coated paper | yes | E |
| ANVcA (0.34) | PE-coated paper | yes | E |

The above results indicate that the subbing layer according to the invention was effective in bonding the dye image-receiving layer to the PET or PE-coated paper support which was subjected to a CDT, in comparison to the control elements which had no subbing layer, had a different subbing layer, or, in the case of PE-coated paper, did not have a CDT.

The invention has been described in detail with particular reference to preferred embodiments thereof, but it will be understood that variations and modifications can be effected within the spirit and scope of the invention.

What is claimed is:

1. A dye-receiving element comprising a support having thereon a subbing layer comprising a vinylidene chloride copolymer and a polymeric dye image-receiving layer containing a thermally-transferred dye image.

2. The element of claim 1 wherein said vinylidene chloride copolymer comprises from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride.

3. The element of claim 2 wherein said ethylenically unsaturated monomer comprises acrylonitrile and said ethylenically unsaturated carboxylic acid comprises either acrylic acid or itaconic acid.

4. The element of claim 3 wherein said subbing layer comprises from about 5 to about 35 percent by weight of acrylonitrile, from about 2 to about 10 percent by weight of acrylic acid, and from about 55 to about 85 percent by weight of recurring units of vinylidene chloride.

5. The element of claim 1 wherein said support is polyethylene-coated paper which has been subjected to a corona discharge treatment.

6. The element of claim 1 wherein said support is poly(ethylene terephthalate).

7. The element of claim 1 wherein said dye image-receiving layer is a bisphenol-A polycarbonate having a number average molecular weight of at least about 25,000.

8. The element of claim 7 wherein said bisphenol-A polycarbonate comprises recurring units having the formula

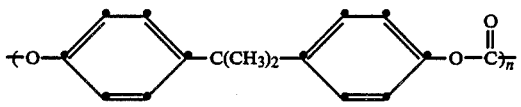

wherein n is from about 100 to about 500.

9. In a process of forming a dye transfer image comprising imagewise-heating a dye-donor element comprising a support having thereon a dye layer and transferring a dye image to a dye-receiving element to form said dye transfer image, said dye-receiving element comprising a support having thereon a polymeric dye image-receiving layer, the improvement wherein said support of said dye-receiving element is coated with a subbing layer comprising a vinylidene chloride copolymer.

10. The process of claim 9 wherein said vinylidene chloride copolymer comprises from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride.

11. The process of claim 10 wherein said ethylenically unsaturated monomer comprises acrylonitrile and said ethylenically unsaturated carboxylic acid comprises either acrylic acid or itaconic acid.

12. The process of claim 10 wherein said support is polyethylene-coated paper which has been subjected to a corona discharge treatment.

13. The process of claim 10 wherein said support is poly(ethylene terephthalate).

14. The process of claim 10, wherein said dye image-receiving layer is a bisphenol-A polycarbonate having a number average molecular weight of at least about 25,000.

15. In a thermal dye transfer assemblage comprising:

(a) a dye-donor element comprising a support having thereon a dye layer, and (b) a dye-receiving element comprising a support having thereon a polymeric dye image-receiving layer, said dye-receiving element being in a superposed relationship with said dye-donor element so that said dye layer is in contact with said dye image-receiving layer, the improvement wherein said support of said dye-receiving element is coated with a subbing layer comprising a vinylidene chloride copolymer.

16. The assemblage of claim 15 wherein said vinylidene chloride copolymer comprises from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride.

17. The assemblage of claim 16 wherein said ethylenically unsaturated monomer comprises acrylonitrile and said ethylenically unsaturated carboxylic acid comprises either acrylic acid or itaconic acid.

18. The assemblage of claim 15 wherein said support is polyethylene-coated paper which has been subjected to a corona discharge treatment.

19. The assemblage of claim 15 wherein said support is poly(ethylene terephthalate).

20. The assemblage of claim 15 wherein said dye image-receiving layer is a bisphenol-A polycarbonate having a number average molecular weight of at least about 25,000.

* * * * *